US007629301B2

(12) United States Patent
Ohmura et al.

(10) Patent No.: US 7,629,301 B2
(45) Date of Patent: Dec. 8, 2009

(54) GREASE COMPOSITION

(75) Inventors: Kazushige Ohmura, Tokyo (JP); Noriaki Shinoda, Tokyo (JP); Keiji Tanaka, Tokyo (JP)

(73) Assignee: Showa Shell Sekiyu K.K., Minato-ku, Tokyo (JP)

( * ) Notice: Subject to any disclaimer, the term of this patent is extended or adjusted under 35 U.S.C. 154(b) by 646 days.

(21) Appl. No.: 10/870,359

(22) Filed: Jun. 17, 2004

(65) Prior Publication Data

US 2005/0003970 A1 Jan. 6, 2005

(30) Foreign Application Priority Data

Jun. 18, 2003 (JP) ..... 2003-174131

(51) Int. Cl.
*C10M 141/10* (2006.01)
*C10M 173/02* (2006.01)

(52) U.S. Cl. ..... 508/365; 508/438

(58) Field of Classification Search ..... 508/365, 508/438

See application file for complete search history.

(56) References Cited

U.S. PATENT DOCUMENTS

| | | | | |
|---|---|---|---|---|
| 5,624,889 | A * | 4/1997 | Ozaki et al. | 508/162 |
| 5,952,273 | A | 9/1999 | Suzuki et al. | 508/168 |
| 6,214,778 | B1 * | 4/2001 | Todd | 508/518 |
| 6,372,695 | B2 * | 4/2002 | Ushida | 508/100 |
| 6,417,143 | B1 * | 7/2002 | Mikami et al. | 508/465 |

FOREIGN PATENT DOCUMENTS

| | | |
|---|---|---|
| EP | 0767237 | 4/1997 |
| EP | 1314774 | 5/2003 |
| JP | 1170690 | 7/1989 |
| JP | 6057283 | 3/1994 |
| JP | 6330072 | 11/1994 |
| JP | 10121080 | 5/1998 |
| JP | 10147791 | 6/1998 |
| JP | 11172276 | 6/1999 |
| JP | 2001049274 | 2/2001 |

* cited by examiner

*Primary Examiner*—Walter D Griffin
*Assistant Examiner*—Frank C Campanell
(74) *Attorney, Agent, or Firm*—Thompson Coburn LLP; Steven M. Ritchey, Esq.

(57) ABSTRACT

A grease composition is provided containing
(a) a base oil;
(b) a urea-based thickening agent;
(c) at least one compound selected from the group of
(i) a molybdenum dithiocarbamate,
(ii) a zinc dithiocarbamate,
(iii) a molybdenum dithiophosphate, and/or
(iv) a zinc dithiophosphate; and
(d) a metal salt of a fatty acid.

16 Claims, No Drawings

GREASE COMPOSITION

The present invention relates to grease compositions.

Greases are typically used in sliding portions in various machines typically including automobiles, construction machines, machine tools, etc.

Such greases are required to have improved frictional properties due to the technical trend of miniaturization as well as performance enhancement of machinery.

Since ball screws, which are widely used in a number of machine parts that perform linear movement, have a structure of transmitting power by the rotation of many balls, the balls and the rotating plane operate in an extremely complicated lubricating mode in which rotary friction and sliding friction co-exist. For example, typical uses of ball screws are in power assisting apparatuses for machine tools, injection moulding machines or electric-powered steering devices for automobiles.

The ball screws of a machine tool are used in the part that moves the bed conducting machining; and the grease to be used in such ball screws must have a frictional coefficient which is stabilized at a low value, because variations in temperature as well as torque due to the frictional heat seriously affect the processing accuracy of the processed product.

For the ball screw of an injection moulding machine, the frictional and abrasive properties are important particularly at the injecting part of an electric-powered moulding machine. In the case where the frictional property is insufficient, shots tend to fluctuate, causing the quality of the product to become unstable. Therefore, the grease to be used is expected to have an excellent frictional property.

Ball screws are further used in the electric-powered steering device that is being rapidly adopted in automobiles. Since the ball screw in this application directly governs the delicate feeling in steering wheel operation, a lubricant having an excellent frictional property is required.

Other typical applications of ball screws are in machines for iron and steel plants. In the iron and steel industry, requirements of energy saving, manpower saving, resource saving and pollution prevention also lead to the demand for greases which are not only provided with heat resistance and abrasion resistance, but which also act to help energy saving due to reduced-friction.

Iron and steel plants have a variety of machine equipment, and the requirements and characteristics for greases vary somewhat depending on the environmental conditions. In the rolling step, which occupies a major part of the demand for grease, greases provided with an excellent frictional property are required to lubricate the shaft bearing and sliding plane of a rolling machine.

To meet these requirements, sulphur/phosphorus-based extreme-pressure agents containing a sulfurized fat or sulfurized olefin combined with zinc dithiophosphate, and lithium-based extreme-pressure greases containing a lead-based additive and molybdenum disulfide are mainly used in the market.

Recently, usage of urea greases excelling in heat resistance have been increasing for certain applications.

Typical preceding technologies in this area are described in Japanese Patent Laid-open No. 2001-49274, Japanese Patent Laid-open No. 170690/1989 and Japanese Patent Laid-open No. 121080/1998.

Japanese Patent Laid-open No. 2001-49274 describes a grease composition for ball screws comprising a urea-based thickening agent and a mineral or synthetic oil having a base oil viscosity of 300 $mm^2/s$ (40° C.). It is indicated therein that by adjusting the blended consistency of said grease composition to 300 dmm or more, durability and lubricating properties may be improved. However, in order to impart a more desirable lubricating property, it is necessary to choose and incorporate an additive excelling in frictional property.

Japanese Patent Laid-open No. 170690/1989 describes a grease composition for automobiles and the iron and steel industry which is said to be provided with an improved lubricating property. Such composition contains a specified diurea compound as the thickening agent and a mineral oil as the base oil. However, for the recent, highly advanced iron and steel equipment and automobiles, a satisfactory level of lubricating property has not yet been achieved.

Examples of urea greases are described in Japanese Patent Laid-open No. 121080/1998, Japanese Patent Laid-open No. 57283/1994, Japanese Patent Laid-open No. 330072/1994, Japanese Patent Laid-open 172276/1999 and Japanese Patent Laid-open No. 147791/1998 which are said to have superior frictional properties.

These documents describe developments which try to improve the frictional property by incorporating into a urea grease a molybdenum sulfurized dialkyldithiocarbamate and other ingredients as additives. However, in view of the recent, severe market requirements, further decrease of friction is still urgently demanded.

It is therefore highly desirable to be able to offer novel grease compositions which have outstanding frictional properties and lubricating performance capable of considerably lowering friction at sites of lubrication, by combining specified additives with a urea grease.

The present invention provides grease compositions which exhibit advantageous lubricating properties. In this regard, different additives and combinations thereof have been evaluated by measuring the coefficients of friction of the greases using a Falex tester as the friction and wear tester.

Accordingly, the present invention provides a grease composition comprising (a) a base oil, (b) a urea-based thickening agent, (c) at least one compound selected from (i) a molybdenum dithiocarbamate, (ii) a zinc dithiocarbamate, (iii) a molybdenum dithiophosphate and/or (iv) a zinc dithiophosphate, and (d) a metal salt of a fatty acid.

A grease composition is provided comprising (a) a base oil;

(b) a urea-based thickening agent;

(c) at least one compound selected from the group consisting of (i) a molybdenum dithiocarbamate, (ii) a zinc dithiocarbamate, (iii) a molybdenum dithiophosphate, (iv) a zinc dithiophosphate, and (v) a mixture thereof; and (d) a metal salt of a fatty acid.

The grease compositions which have excellent friction-lowering properties at sites of lubrication and which are ideal for ball screws, various kinds of gears and bearings of rollers for iron and steel.

In a preferred embodiment of the present invention there is provided a grease composition comprising (a) a base oil;

(b) a urea-based thickening agent;

(c) at least one compound selected from the group of (i) a molybdenum dithiocarbamate represented by general formula (1)

(1)

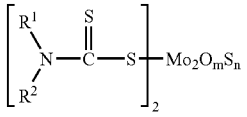

wherein, $R^1$ and $R^2$ each independently represent a group selected from alkyl groups and aryl groups and m+n=4, m is 0 to 3 and n is 4 to 1, (ii) a zinc dithiocarbamate represented by general formula (2)

(2)

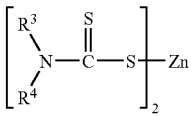

wherein, $R^3$ and $R^4$ each independently represent a group selected from alkyl groups and aryl groups, (iii) a molybdenum dithiophosphates represented by general formula (3)

(3)

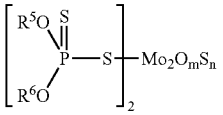

wherein, $R^5$ and $R^6$ each independently represent a group selected from alkyl groups and aryl groups, m+n=4, m is 0 to 3 and n is 4 to 1, and/or (iv) a zinc dithiophosphate represented by general formula (4)

(4)

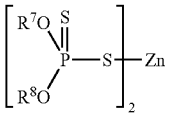

wherein, $R^7$ and $R^8$ each independently represent a group selected from alkyl groups and aryl groups; and (d) a metal salt of a fatty acid.

Component (b) is preferably present in the composition of the present invention in an amount in the range of from 2 to 35 wt %, based on the total weight of the composition.

Component (c) is preferably present in the composition of the present invention in an amount in the range of from 0.5 to 10% by weight, based on the total weight of the composition.

Component (d) is preferably present in the composition of the present invention in an amount in the range of from 0.1 to 10% by weight, based on the total weight of the composition.

The base oil used as component (a) in the composition of the present invention may conveniently be a mineral oil or/and a synthetic oil.

Base oils of mineral origin may include those produced by solvent refining or hydroprocessing.

Examples of mineral oils that may conveniently be used include those sold by member companies of the Royal Dutch/Shell Group under the designations "HVI", "MVIN", or "HMVIP".

Specific examples of synthetic oils that may be conveniently used include polyolefins such as α-olefin oligomers and polybutene, poly(alkylene glycol)s such as poly(ethylene glycol) and poly(propylene glycol), diesters such as di-2-ethylhexyl sebacate and di-2-ethylhexyl adipate, polyol esters such as trimethylol-propane esters and pentaerythritol esters, perfluoroalkyl ethers, silicone oils and polyphenyl ethers single or as mixed oils.

Polyalphaolefins and base oils of the type manufactured by the hydroisomerisation of wax, such as those sold by member companies of the Royal Dutch/Shell Group under the designation "XHVI" (trade mark), may also be used.

Urea thickeners which may be used as component (b) in the composition of the present invention include diurea, triurea and tetraurea compounds, and urea/urethane compounds.

Representative examples of diurea compounds include products of reaction between diisocyanates and monoamines: diisocyanates include diphenylmethane diisocyanate, phenylene diisocyanate, diphenyl diisocyanate, phenyl diisocyanate and trilene diisocyanate, and monoamines include octylamine, dodecylamine, hexadecylamine, octadecylamine and oleylamine. However, any known urea thickener may be conveniently used in the grease composition of the present invention.

When the quantity of urea thickener as component (b) is less than 2 wt % there may be little thickening effect and it may be difficult to form a grease. When the quantity of said thickener exceeds 35 wt %, the grease may become too stiff and it may be difficult to obtain an adequate lubricating effect.

In the aforementioned components (c) (i)-(iv), $R^1$ and $R^2$, $R^3$ and $R^4$, $R^5$ and $R^6$, and $R^7$ and $R^8$ in general formulae (1)-(4), respectively, are groups independently selected from a set comprising alkyl groups and aryl groups. The alkyl groups may be straight chain, branched-chain or cyclic alkyl groups or aralkyl groups, and preferably have 1-24 carbon atoms therein. Similarly, the aryl groups may be unsubstituted or alkyl substituted aryl groups.

Specific examples of molybdenum dithiocarbamates which may be conveniently employed as component (c) (i) include molybdenum diethyldithiocarbamate, molybdenum dipropyldithiocarbamate, molybdenum dibutyldithiocarbamate, molybdenum dipentyldithiocarbamate, molybdenum dihexyldithiocarbamate, molybdenum didecyldithiocarbamate, molybdenum diisobutyldithiocarbamate, molybdenum di(2-ethylhexyl)dithiocarbamate, molybdenum diamyldithiocarbamate, molybdenum dilauryldithiocarbamate, molybdenum distearyldithiocarbamate, molybdenum diphenyldithiocarbamate, molybdenum ditolyldithiocarbamate, molybdenum dixylyldithiocarbamate, molybdenum diethylphenyldithiocarbamate, molybdenum dipropylphenyldithiocarbamate, molybdenum dibutylphenyldithiocarbamate, molybdenum dipenytlphenyldithiocarbamate, molybdenum dihexylphenyldithiocarbamate, molybdenum diheptyldithiocarbamate, molybdenum dioctylphenyldithiocarbamate, molybdenum dinonylphenyldithiocarbamate, molybdenum didecylphenyldithiocarbamate, molybdenum didodecylphenyldithiocarbamate, molybdenum ditetradecylphenyldithiocarbamate and molybdenum dihexadecylphenyldithiocarbamate.

Specific examples of zinc dithiocarbamates which may be conveniently employed as component (c) (ii) include zinc diethyldithiocarbamate, zinc dipropyldithiocarbamate, zinc dibutyldithiocarbamate, zinc dipentyldithiocarbamate, zinc dihexyldithiocarbamate, zinc didecyldithiocarbamate, zinc diisobutyldithiocarbamate, zinc di(2-ethylhexyl)-dithiocarbamate, zinc diamyldithiocarbamate, zinc dilauryldithiocarbamate, zinc distearyldithiocarbamate and zinc diphenyldithiocarbamate, etc., and zinc ditolyldithiocarbamate, zinc dixylyldithiocarbamate, zinc diethylphenyldithiocarbamate, zinc dipropylphenyldithiocarbamate, zinc dibutylphenyldithiocarbamate, zinc dipentylphenyldithiocarbamate, zinc dihexylphenyldithiocarbamate, zinc diheptylphenyldithiocarbamate, zinc dioctylphenyldithiocarbamate, zinc dinonylphenyldithiocarbamate, zinc didecylphenyldithiocarbamate, zinc didodecylphenyldithiocarbamate, zinc ditetradecylphenyldithiocarbamate and zinc dihexadecylphenyldithiocarbamate.

Specific examples of molybdenum dithiophosphates which may be conveniently employed as component (c) (iii) include molybdenum diethyldithiophosphate, molybdenum dipropyl dithiophosphate, molybdenum dibutyldithiophosphate, molybdenum dipentyldithiophosphate, molybdenum dihexyldithiophosphate, molybdenum didecyldithiophosphate, molybdenum diisobutyldithiophosphate, molybdenum di(2-ethylhexyl)dithiophosphate, molybdenum diamyldithiophosphate, molybdenum dilauryldithiophosphate, molybdenum distearyldithiophosphate etc., and molybdenum diphenyldithiophosphate, molybdenum ditolyldithiophosphate, -molybdenum dixylyldithiophosphate, molybdenum diethylphenyldithiophosphate, molybdenum dipropylphenyldithiophosphate, molybdenum dibutylphenyldithiophosphate, molybdenum dipentylphenyldithiophosphate, molybdenum dihexylphenyldithiophosphate, molybdenum diheptylphenyldithiophosphate, molybdenum dioctylphenyldithiophosphate, molybdenum dinonylphenyldithiophosphate, molybdenum didecylphenyldithiophosphate, molybdenum didodecylphenyldithiophosphate, molybdenum ditetradecylphenyldithiophosphate and molybdenum dihexadecylphenyldithiophosphate.

Specific examples of zinc dithiophosphates which may be conveniently employed as component (c) (iv) include zinc diethyldithiophosphate, zinc dipropyl dithiophosphate, zinc dibutyldithiophosphate, zinc dipentyldithiophosphate, zinc dihexyldithiophosphate, zinc didecyldithiophosphate, zinc diisobutyldithiophosphate, zinc di(2-ethylhexyl)dithiophosphate, zinc diamyldithiophosphate, zinc dilauryldithiophosphate, zinc distearyldithiophosphate, zinc diphenyldithiophosphate etc., and -zinc ditolyldithiophosphate, zinc dixylyldithiophosphate, zinc diethylphenyldithiophosphate, zinc dipropylphenyldithiophosphate, zinc dibutylphenyldithiophosphate, zinc dipentylphenyldithiophosphate, zinc dihexylphenyldithiophosphate, zinc diheptylphenyldithiophosphate, zinc dioctylphenyldithiophosphate, zinc dinonylphenyldithiophosphate, zinc didecylphenyldithiophosphate, zinc didodecylphenyldithiophosphate, zinc ditetradecylphenyldithiophosphate and zinc dihexadecylphenyldithiophosphate The quantity of component (c) in the composition of the present invention is preferably in the range of from 0.5 to 10 wt %, and more preferably in the range of from 0.5 to 5 wt %, based on the total weight of the composition.

Inclusion of more than 10 wt % of component (c) in the composition of the present invention may not have any additional effect in decreasing the coefficient of friction. Inclusion of less than 0.5 wt % of component (c) in the composition of the present invention, may result in no noticeable improvement in frictional properties.

Examples of metal salts of fatty acids which may be conveniently employed as component (d) include salts formed by reacting a C6-24 straight-chain saturated or unsaturated aliphatic monocarboxylic acid (which can also include one hydroxyl group) such as lauric acid, myristic acid, palmitic acid, stearic acid, 12-hydroxystearic acid, arachidic acid, behenic acid, lignoceric acid, oleic acid, linoleic acid, linolenic acid or ricinoleic acid, and a metal.

The metal salts of fatty acids which are employed as component (d) are preferably one or more of lithium, sodium, magnesium, aluminium, calcium, zinc and/or barium metal salts.

Fatty acid metal salts of a C12-18 aliphatic monocarboxylic acid with lithium, magnesium, aluminium, calcium and/or zinc are particularly preferred.

The quantity of the metal salt(s) of a fatty acid(s) added as component (d) to the composition of the present invention is preferably in the range of from 0.1 to 10 wt %, and more preferably in the range of from 0.1 to 5 wt %, based on the total weight of the composition.

Inclusion of more than 10 wt % of component (d) in the composition of the present invention may not have any additional effect in decreasing the coefficient of friction. Moreover, the stiffness of the grease may be increased and it may be difficult to obtain the texture originally intended. Inclusion of less than 0.1 wt % of component (d) in the composition of the present invention, may result in no noticeable improvement in frictional properties.

Additives such as antioxidants, anticorrosive agents, extreme pressure agents and polymers may also be conveniently added to compositions of the present invention in order to further improve the performance thereof.

For example, antioxidants including alkylphenol, hindered phenol, alkylamine, diphenylamine and triazine antioxidants; anticorrosion agents including calcium sulphonate, sodium sulphonate, barium sulphonate and amino derivatives or metal salts of carboxylic acids; and extreme pressure agents including sulphurized oils or fats, sulphurized olefins, phosphoric acid esters, tricresyl phosphate, trialkyl thiophosphates and triphenyl phosphorothionates may be conveniently used.

Lubricants for ball joints may advantageously comprise the urea grease composition described above.

Accordingly, the present invention further provides a method of lubricating a ball joint comprising packing the ball joint with the urea grease composition.

The urea grease composition of the present invention is useful as a friction-reducing grease composition and, in particular, useful to reduce friction in a ball joint.

The present invention is described below with reference to the following Examples, which are not intended to limit the scope of the present invention in any way.

EXAMPLES

N.B. The numbers in the composition columns in the following tables are wt %.

The compositions of the Examples and Comparative Examples presented in Tables 1-5 were produced by adding a metal salt of a fatty acid as an additive, by melting it in the base grease described below and then adding at least one compound selected from a set comprising molybdenum dithiocarbamates, zinc dithiocarbamates, molybdenum dithiophosphates and zinc dithiophosphates. The mixture was homogenised using a three roll mill.

Examples 1-7 were grease compositions with different fatty acid metal salts (as component (d)) combined with a molybdenum dithiocarbamate (Mo-DTC) (as component (c)); Examples 8-9 were grease compositions with different fatty acid metal salts (as component (d)) combined with a molybdenum dithiophosphate (Mo-DTP) (as component (c)); Examples 10-12 were grease compositions with different fatty acid metal salts combined with a zinc dithiocarbamate (Zn-DTC) or zinc dithiophosphate (Zn-DTP) (as component (c)); and Examples 13-15 were grease compositions with different fatty acid metal salts (as component (d)) combined with a mixture of two compounds as described herein (as component (c)).

Comparative Examples 1-4 were urea grease compositions including only a molybdenum dithiocarbamate, a molybdenum dithiophosphate or a fatty acid metal salt; Comparative Example 5 was a urea grease composition including a combination of a molybdenum dithiocarbamate and molybdenum dithiophosphate; Comparative Examples 6 and 7 were lithium grease compositions including a combination of molybdenum dithiocarbamate or molybdenum dithiophosphate and a fatty acid metal salt; and Comparative Examples 8-10 were urea grease compositions combined only with a mixture of two compounds as described herein as component (c).

The urea base grease employed in the Examples and Comparative Examples below was a base grease obtained from mineral oil (5100 g) having a dynamic viscosity of approximately 15 $mm^2/s$ at 100° C. by homogeneously dispersing therein a urea compound obtained by reacting 1 mole of 4,4-diphenylmethane diisocyanate (292.2 g) with 2 moles of octylamine (607.8 g). The content of the urea compound in this grease to adjusted to 15 wt %.

The lithium base grease used in the Comparative Examples 6 and 7 below was a base grease obtained by adding the mineral oil (4900 g) having a dynamic viscosity of approximately 15 $mm^2/s$ at 100° C. by dissolving 100 g of lithium stearate. The content of the lithium compound in this grease was adjusted to 10 wt %.

The consistency, dropping point and frictional coefficient shown in the tables were evaluated by performing the following tests.

(1) Consistency

Measured on the basis of the test for consistency in JIS K2220.

(2) Dropping Point

Measured on the basis of the test for dropping point in JIS K2220.

(3) Coefficient of Friction

The coefficient of friction was measured using a Falex test under the conditions below (test method in the UK Standard IP 241 (1969)). The test time was 15 minutes and the coefficient of friction was found at the end (after 15 minutes).

| Test conditions | |
|---|---|
| Rotation speed | 290 rpm |
| Load | 200 lb |
| Temperature | Room temperature |
| Time | 15 minutes |
| Grease | Approximately 1 g of grease applied to the test piece |

Testing was carried out using a "Shinko Seiki Falex" friction tester.

TABLE 1

| | | | Example | | | | |
|---|---|---|---|---|---|---|---|
| | | | 1 | 2 | 3 | 4 | 5 |
| Composition | Base grease (% wt) | Urea | 96.0 | 96.0 | 96.0 | 96.0 | 96.0 |
| | Additive Component (c) (% wt) | (i) Mo-DTC | 2.0 | 2.0 | 2.0 | 2.0 | 2.0 |
| | | (ii) Zn-DTC | | | | | |
| | | (iii) Mo-DTP | | | | | |
| | | (iv) Zn-DTP | | | | | |
| | Additive Component (d) (% wt) | Zn stearate | 2.0 | | | | |
| | | Mg stearate | | 2.0 | | | |
| | | Al stearate | | | 2.0 | | |
| | | Ca stearate | | | | 2.0 | |
| | | Li stearate | | | | | 2.0 |
| | | Zn laurate | | | | | |
| | | Zn myristate | | | | | |
| Test results | Consistency 60 W (dmm) | | 265 | 260 | 268 | 270 | 265 |
| | Dropping point (° C.) | | >250 | >250 | >250 | >250 | >250 |
| | Falex test Coefficient of friction | | 0.052 | 0.051 | 0.053 | 0.057 | 0.056 |

TABLE 2

| | | | Example | | | | |
|---|---|---|---|---|---|---|---|
| | | | 6 | 7 | 8 | 9 | 10 |
| Composition | Base grease (% wt) | Urea | 96.0 | 94.0 | 96.0 | 96.0 | 95.0 |
| | Additive Component (c) (% wt) | (i) Mo-DTC | 2.0 | 2.0 | | | |
| | | (ii) Zn-DTC | | | | | |
| | | (iii) Mo-DTP | | | 2.0 | 2.0 | |
| | | (iv) Zn-DTP | | | | | 2.0 |
| | Additive Component (d) (% wt) | Zn stearate | | | 2.0 | | |
| | | Mg stearate | | | | 2.0 | 3.0 |
| | | Al stearate | | | | | |
| | | Ca stearate | | | | | |
| | | Li stearate | | | | | |

TABLE 2-continued

| | | | Example | | | | |
|---|---|---|---|---|---|---|---|
| | | | 6 | 7 | 8 | 9 | 10 |
| | | Zn laurate | 2.0 | | | | |
| | | Zn myristate | | 4.0 | | | |
| Test results | Consistency 60 W (dmm) | | 275 | 278 | 272 | 269 | 280 |
| | Dropping point (° C.) | | >250 | >250 | >250 | >250 | >250 |
| | Falex test | Coefficient of friction | 0.051 | 0.059 | 0.053 | 0.052 | 0.052 |

TABLE 3

| | | | Example | | | | |
|---|---|---|---|---|---|---|---|
| | | | 11 | 12 | 13 | 14 | 15 |
| Composition | Base grease (% wt) | Urea | 97.0 | 96.0 | 94.0 | 94.0 | 93.0 |
| | Additive | (i) Mo-DTC | | | | 2.0 | 2.0 |
| | Component (c) | (ii) Zn-DTC | 2.0 | | 2.0 | 2.0 | |
| | (% wt) | (iii) Mo-DTP | | | | | |
| | | (iv) Zn-DTP | | 2.0 | 2.0 | | 2.0 |
| | Additive | Zn stearate | | 2.0 | | | 1.0 |
| | Component (d) | Mg stearate | 1.0 | | | 2.0 | |
| | (% wt) | Al stearate | | | | | |
| | | Ca stearate | | | 2.0 | | |
| | | Li stearate | | | | | 2.0 |
| | | Zn laurate | | | | | |
| | | Zn myristate | | | | | |
| Test results | Consistency 60 W (dmm) | | 278 | 281 | 276 | 269 | 275 |
| | Dropping point (° C.) | | >250 | >250 | >250 | >250 | >250 |
| | Falex test | Coefficient of friction | 0.058 | 0.048 | 0.056 | 0.047 | 0.048 |

TABLE 4

| | | | Comparative Example | | | | |
|---|---|---|---|---|---|---|---|
| | | | 1 | 2 | 3 | 4 | 5 |
| Composition | Base grease (% wt) | Urea | 97.0 | 97.0 | 98.0 | 98.0 | 96.0 |
| | Additive Component | (i) Mo-DTC | 3.0 | | | | 3.0 |
| | (c) | (iii) Mo-DTP | | 3.0 | | | 1.0 |
| | (% wt) | | | | | | |
| | Additive Component | Zn stearate | | | | | |
| | (d) | Mg stearate | | | 2.0 | | |
| | (% wt) | Al stearate | | | | | |
| | | Ca stearate | | | | | |
| | | Li stearate | | | | | |
| | | Zn laurate | | | | | |
| | | Zn myristate | | | | 2.0 | |
| Test results | Consistency 60 W (dmm) | | 279 | 288 | 263 | 272 | 280 |
| | Dropping point (° C.) | | >250 | >250 | >250 | >250 | >250 |
| | Falex test | Coefficient of friction | 0.090 | 0.091 | 0.095 | 0.100 | 0.088 |

TABLE 5

| | | | Comparative Example | | | | |
|---|---|---|---|---|---|---|---|
| | | | 6 | 7 | 8 | 9 | 10 |
| Composition | Base grease (% wt) | Urea | | | 97.0 | 96.0 | 96.0 |
| | | Lithium | 97.0 | 96.0 | | | |
| | Additive | (i) Mo-DTC | 2.0 | | 2.0 | | |
| | Component (c) | (ii) Zn-DTC | | | 1.0 | 2.0 | 2.0 |
| | (% wt) | (iii) Mo-DTP | | 2.0 | | | 2.0 |
| | | (iv) Zn-DTP | | | | 2.0 | |
| | Additive | Zn stearate | 1.0 | | | | |
| | Component (d) | Mg stearate | | 2.0 | | | |
| | (% wt) | Ca stearate | | | | | |
| Test results | Consistency 60 W (dmm) | | 294 | 298 | 280 | 280 | 285 |
| | Dropping point (° C.) | | 190 | 189 | >250 | >250 | >250 |
| | Falex test | Coefficient of friction | 0.093 | 0.090 | 0.090 | 0.091 | 0.093 |

It is evident that the compositions of Examples 1-15, wherein component (c) is at least one compound selected from the group of (i) Mo-DTC, (ii) Zn-DTC, (iii) Mo-DTP and (iv) Zn-DTP combined with component (d), i.e. a fatty acid metal salt in urea grease, gave clearly better coefficients of friction than the compositions of the Comparative Examples.

Comparative Examples 1-4 have only a single additive, Comparative Example 5 employed a combination of (i) Mo-DTC and (iii) Mo-DTP as component (c) but did not contain a fatty acid metal salt (i.e. component (d).

Comparative Examples 6 and 7 use lithium grease as the base grease, and Comparative Examples 8-10 contained only a combination of two compounds selected from Mo-DTC, Zn-DTC, Mo-DTP and Zn-DTP as component (c), and no compound as component (d).

It is thus evident that only a combination of urea grease as the base grease, together with at least one compound selected from (i) a Mo-DTC, (ii) a Zn-DTC, (iii) a Mo-DTP and (iv) a Zn-DTP as component (c) and a fatty acid metal salt as component (d) gives rise to a surprising synergistic reduction in friction.

Thus, it is evident that the present invention provides a grease composition which has outstanding frictional properties and which can greatly decrease the coefficient of friction at the site lubricated therewith.

We claim:

1. A method of lubricating a ball screw, comprising packing said ball screw with a grease composition comprising:

(a) a base oil;

(b) a urea-based thickening agent;

(c) at least one compound selected from the group consisting of (i) a molybdenum dithiocarbamate, (ii) a zinc dithiocarbamate, (iii) a molybdenum dithiophosphate, (iv) a zinc dithiophosphate, and (v) a mixture thereof; and (d) a metal salt of a fatty acid.

2. The method of claim 1 wherein the grease composition comprises:

(a) a base oil;

(b) a urea-based thickening agent;

(c) at least one compound selected from the group consisting of (i) a molybdenum dithiocarbamate represented by the general formula (1):

(1)

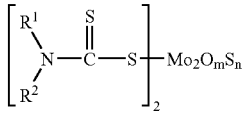

wherein, $R^1$ and $R^2$ each independently represent a group selected from alkyl groups and aryl groups and m+n=4, m is 0 to 3, and n is 4 to 1, (ii) a zinc dithiocarbamate represented by the general formula (2):

(2)

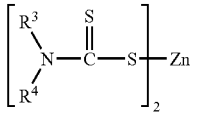

wherein, $R^3$ and $R^4$ each independently represent a group selected from alkyl groups and aryl groups, (iii) a molybdenum dithiophosphate represented by the general formula (3):

(3)

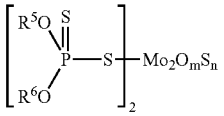

wherein, $R^5$ and $R^6$ each independently represent a group selected from alkyl groups and aryl groups, m+n=4, m is 0 to 3, and n is 4 to 1, (iv) a zinc dithiophosphate represented by the general formula (4):

(4)

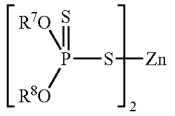

wherein, $R^7$ and $R^8$ each independently represent a group selected from alkyl groups and aryl groups, and (v) a mixture thereof; and (d) a metal salt of a fatty acid.

3. The method of claim 1 wherein component (b) of the grease composition is present in an amount in the range of from 2 to 35% by weight, based on the total weight of the composition.

4. The method of claim 2 wherein component (b) of the grease composition is present in an amount in the range of from 2 to 35% by weight, based on the total weight of the composition.

5. The method of claim 1 wherein component (c) of the grease composition is present in an amount in the range of from 0.5 to 10% by weight, based on the total weight of the composition.

6. The method of claim 2 wherein component (c) of the grease composition is present in an amount in the range of from 0.5 to 10% by weight, based on the total weight of the composition.

7. The method of claim 1 wherein component (d) of the grease composition is present in an amount in the range of from 0.1 to 10% by weight, based on the total weight of the composition.

8. The method of claim 2 wherein component (d) of the grease composition is present in an amount in the range of from 0.1 to 10% by weight, based on the total weight of the composition.

9. The method of claim 1 wherein component (d) of the grease composition is present in an amount in the range of from 0.1 to 5% by weight, based on the total weight of the composition.

10. The method of claim 2 wherein component (d) of the grease composition is present in an amount in the range of from 0.1 to 5% by weight, based on the total weight of the composition.

11. The method of claim 1 wherein component (d) of the grease composition is a salt formed by reacting a C6-24 straight-chain saturated or unsaturated aliphatic monocarboxylic acid and a metal.

12. The method of claim 2 wherein component (d) of the grease composition is a salt formed by reacting a C6-24 straight-chain saturated or unsaturated aliphatic monocarboxylic acid and a metal.

13. The method of claim 1 wherein component (d) of the grease composition is at least one compound selected from lithium, sodium, magnesium, aluminium, calcium, zinc and/or barium metal salts of fatty acids.

14. The method of claim 2 wherein component (d) of the grease composition is at least one compound selected from lithium, sodium, magnesium, aluminium, calcium, zinc and/or barium metal salts of fatty acids.

15. The method of claim 1 wherein component (d) of the grease composition is a fatty acid metal salt of a C12-18 aliphatic monocarboxylic acid with lithium, magnesium, aluminium, calcium and/or zinc.

16. The method of claim 2 wherein component (d) of the grease composition is a fatty acid metal salt of a C12-18 aliphatic monocarboxylic acid with lithium, magnesium, aluminium, calcium and/or zinc.

* * * * *